US005653582A

United States Patent [19]

Harvey et al.

[11] Patent Number: 5,653,582

[45] Date of Patent: Aug. 5, 1997

[54] FLUID BEARING PAD ARRANGEMENT FOR LIQUID RING PUMP SYSTEMS

[75] Inventors: Andrew C. Harvey, Waltham, Mass.; Richard G. Cadotte, Norwalk, Conn.; Thomas R. Dardis, Milford, Conn.; Harold K. Haavik, South Norwalk, Conn.; Ellis J. Cooper, Bridgeport, Conn.

[73] Assignee: The Nash Engineering Company, Trumbull, Conn.

[21] Appl. No.: 533,840

[22] Filed: Sep. 26, 1995

[51] Int. Cl.[6] ..... F04C 19/00

[52] U.S. Cl. ..... 417/68; 384/116; 384/117

[58] Field of Search ..... 417/68, 69; 384/116, 384/117, 114, 121, 122

[56] References Cited

U.S. PATENT DOCUMENTS

| | | | |
|---|---|---|---|
| 1,177,959 | 4/1916 | McFarlane | 417/68 |
| 2,609,139 | 9/1952 | Kollsman . | |
| 3,703,322 | 11/1972 | Gustafsson | 384/116 |
| 3,782,791 | 1/1974 | Neumann et al. | 308/9 |
| 4,060,288 | 11/1977 | Arsenius et al. | 384/116 |
| 4,194,796 | 3/1980 | Svensson et al. | 384/116 |
| 4,465,383 | 8/1984 | Heinemann et al. | 384/116 |
| 5,100,300 | 3/1992 | Haavik | 417/68 |
| 5,197,863 | 3/1993 | Dardis et al. | 417/68 |
| 5,213,479 | 5/1993 | Dardis et al. . | |
| 5,217,352 | 6/1993 | Haavik . | |
| 5,295,794 | 3/1994 | Haavik | 417/68 |
| 5,370,502 | 12/1994 | Haavik et al. . | |

FOREIGN PATENT DOCUMENTS

| | | | |
|---|---|---|---|
| 0 599 545 A1 | 6/1994 | European Pat. Off. . | |
| 587533 | 10/1933 | Germany . | |
| 686937 | 12/1939 | Germany . | |
| 876286 | 5/1953 | Germany | 417/68 |
| 1017740 | 10/1957 | Germany . | |
| 3115577 | 11/1982 | Germany . | |
| 212498 | 11/1940 | Switzerland . | |
| 219072 | 5/1968 | U.S.S.R. . | |
| 309155 | 7/1971 | U.S.S.R. . | |
| 939826 | 6/1982 | U.S.S.R. . | |
| 1019109 | 5/1983 | U.S.S.R. . | |
| 1021815 | 6/1983 | U.S.S.R. . | |
| 1035290 | 8/1983 | U.S.S.R. . | |
| 1038583 | 8/1983 | U.S.S.R. . | |
| 1040221 | 9/1983 | U.S.S.R. . | |
| 1121500 | 10/1984 | U.S.S.R. . | |
| 1195055 | 11/1985 | U.S.S.R. . | |
| 1268809 | 11/1986 | U.S.S.R. . | |
| 1392249 | 4/1988 | U.S.S.R. . | |
| 1460417 | 2/1989 | U.S.S.R. . | |
| 1523727 | 11/1989 | U.S.S.R. . | |
| WO 94/16227 | 7/1994 | WIPO . | |
| WO 96/22467 | 7/1996 | WIPO . | |

OTHER PUBLICATIONS

V.D. Lubenets et al., "Results of Testing a Liquid Ring Pump with a Rotating Liner," Vacuum Physics and Technology, 1974, pp. 191–194.

V.D. Lubenets et al., "Effect of a Rotating Liner on the Characteristics of a Liquid Ring Machine," Khimicheskoe l Neftyanoe Mashinostroenie, No. 3, pp. 16–18, Mar. 1984.

*Primary Examiner*—Timothy Thorpe
*Assistant Examiner*—Roland G. McAndrews, Jr.
*Attorney, Agent, or Firm*—Fish & Neave; Robert R. Jackson; G. Victor Treyz

[57] ABSTRACT

Liquid ring pumps with rotating canisters are supported by at least one radial fluid bearing pad. The bearing fluid is either a gas or a liquid. The radial fluid bearing pads can be of either the hydrodynamic or hydrostatic type. Holes in each bearing pad are used to introduce bearing fluid to the clearance between the rotating canister and the housing of the pump. Each radial bearing pad can be mounted to the housing using a ball joint or a bladder. Access ports formed in the housing provide access to the radial bearing pads. Axial fluid bearings are mounted to the housing using shims or threaded bolts so that the axial position of the axial bearings can be adjusted.

19 Claims, 15 Drawing Sheets

FLUID BEARING PAD ARRANGEMENT FOR LIQUID RING PUMP SYSTEMS

BACKGROUND OF THE INVENTION

This invention relates to liquid ring pumps for pumping gases or vapors (hereinafter generically "gas") to compress the gas or to produce a reduced gas pressure region ("vacuum"). More particularly, the invention relates to liquid ring pumps having rotating canisters that are supported by fluid bearing pads.

Liquid ring pumps are well known as shown, for example, by Bissell et al. U.S. Pat. No. 4,498,844. In most such pumps a rotor is rotatably mounted in a stationary annular housing so that the rotor axis is eccentric to the central axis of the housing. The rotor has blades which extend parallel to the rotor axis and which project radially out from that axis so that the blades are equally spaced in the circumferential direction around the rotor. A quantity of a pumping liquid such as water is maintained in the housing. As the rotor rotates, the rotor blades engage the liquid and form it into an annular ring inside the housing. Because the housing is eccentric to the rotor, the liquid ring is also eccentric to the rotor. This means that on one side of the pump—the intake zone—the liquid between adjacent rotor blades is moving radially outward, away from the rotor hub, while on the other side of the pump—the compression zone— the liquid between adjacent rotor blades is moving radially inward toward the rotor hub. A gas intake is connected to the intake zone so that gas to be pumped is pulled into the spaces between adjacent rotor blades where the liquid is moving radially outward. A gas discharge is connected to the compression zone so that gas compressed by the liquid moving radially inward can be discharged from the pump.

A major cause of energy loss in liquid ring pumps is fluid friction between the liquid ring and the stationary housing. Energy loss due to such fluid friction is proportional to the square or an even higher power of the velocity difference between the liquid ring and the housing. To reduce such losses, a substantially cylindrical hollow canister can be provided inside the outer periphery of the pump housing. The housing is stationary, but the canister is free to rotate with the liquid ring. The canister, which is propelled by the fluid drag on its inner surface, tends to rotate at a velocity less than the liquid ring velocity. For example, if the canister velocity is half the liquid ring velocity the fluid friction energy loss between the liquid ring and the canister is one quarter (or less) of the energy loss with no rotating canister.

In order to allow the canister to rotate freely, it must be supported within the housing, for example, by mechanical bearings. As described in Haavik U.S. Pat. No. 5,100,300, the canister can also be supported for rotation by an annular fluid bearing formed by placing a pressurized bearing liquid in the annular clearance between the canister and the stationary housing. In Russian patent 939,826, gas is mixed with the bearing liquid to reduce frictional resistance to rotation of the canister. The frictional drag on the rotating canister can be reduced even more by completely or substantially completely substituting compressed gas for liquid as the rotating canister bearing fluid, as shown in Haavik et al. U.S. Pat. No. 5,370,502.

However, there are several concerns with pumps that use annular fluid bearings to support the rotating canister. One concern is that the thickness of the clearance between the rotating canister and the housing must be fairly small. When compressed gas is used as the bearing fluid, the thickness of the clearance in the radial direction is typically about 0.001 inch. When water is used as the bearing fluid, a typical clearance thickness may be in the range from about 0.002 inch to 0.005 inch. Fairly precise manufacturing techniques must be used to construct pumps with such small clearance thicknesses.

Another concern, especially when liquids are used for the bearing fluid, is that the friction between an annular fluid bearing and the canister may not be as low as it could be. Although this is not as great a concern for rotating canister pumps that use gas for the bearing fluid, any reduction in bearing friction would help to reduce energy loss in the pump.

Further, it would be desirable to be able to provide easily adjustable axial fluid bearings, so that the rotating canister can be confined to a desired axial location.

It is therefore an object of the invention to provide an improved radial fluid bearing for a rotating canister liquid ring pump.

It is another object of the invention to provide an adjustable axial fluid bearing for a rotating canister liquid ring pump.

SUMMARY OF THE INVENTION

These and other objects of the invention are accomplished in accordance with the principles of the invention by providing liquid ring pumps having rotating canisters that can be supported by one or more radially located fluid bearing pads. The position of at least some of the pads may be individually adjustable relative to the housing so that the canister can be positioned properly relative to the housing. At least some of the pads may be mounted using flexible structures, such as ball joints or bladders, which allow the pads to move individually relative to the housing to accommodate variations in the shape and position of the canister.

The bearing pads can be used to form bearings of either the hydrodynamic or hydrostatic bearing type. When the bearing pads are of the hydrostatic type, the bearing fluid may be either gas or liquid. When the bearing pads are of the hydrodynamic bearing type, the bearing fluid is preferably liquid.

Bearing fluid can be introduced into the clearance between the surface of each bearing pad and the canister using any suitable structure. For example, when bearing pads are of the hydrodynamic bearing type, the surface of the canister can be lubricated adjacent to the clearance between the canister and the bearing pads using a low pressure supply of liquid. Grooves or holes can also be formed in the bearing pad to facilitate the distribution of liquid into the clearance. When the bearing pads are of the hydrostatic type, pressurized bearing fluid is preferably introduced into the clearance between the surface of the bearing pads and the canister via a number of holes in each pad.

One or more axially located fluid bearing pads are also provided that are used to axially confine the canister. The axial position of these bearing pads can be individually adjusted relative to the remainder of the pump structure to position the canister relative to the housing. Adjustment of the position of the axial bearing pads may be made independent from any adjustment that is made to the cone-rotor clearance in the pump. Preferably, the axial bearing pads are of the hydrodynamic bearing type.

Access ports in the pump housing are preferably located adjacent to both the radial and axial bearing pads. The access ports facilitate the pad adjustment and allow the bearing pads to be readily accessed by service personnel operating in the field.

DETAILED DESCRIPTION OF THE PREFERRED EMBODIMENTS

Figure 1:
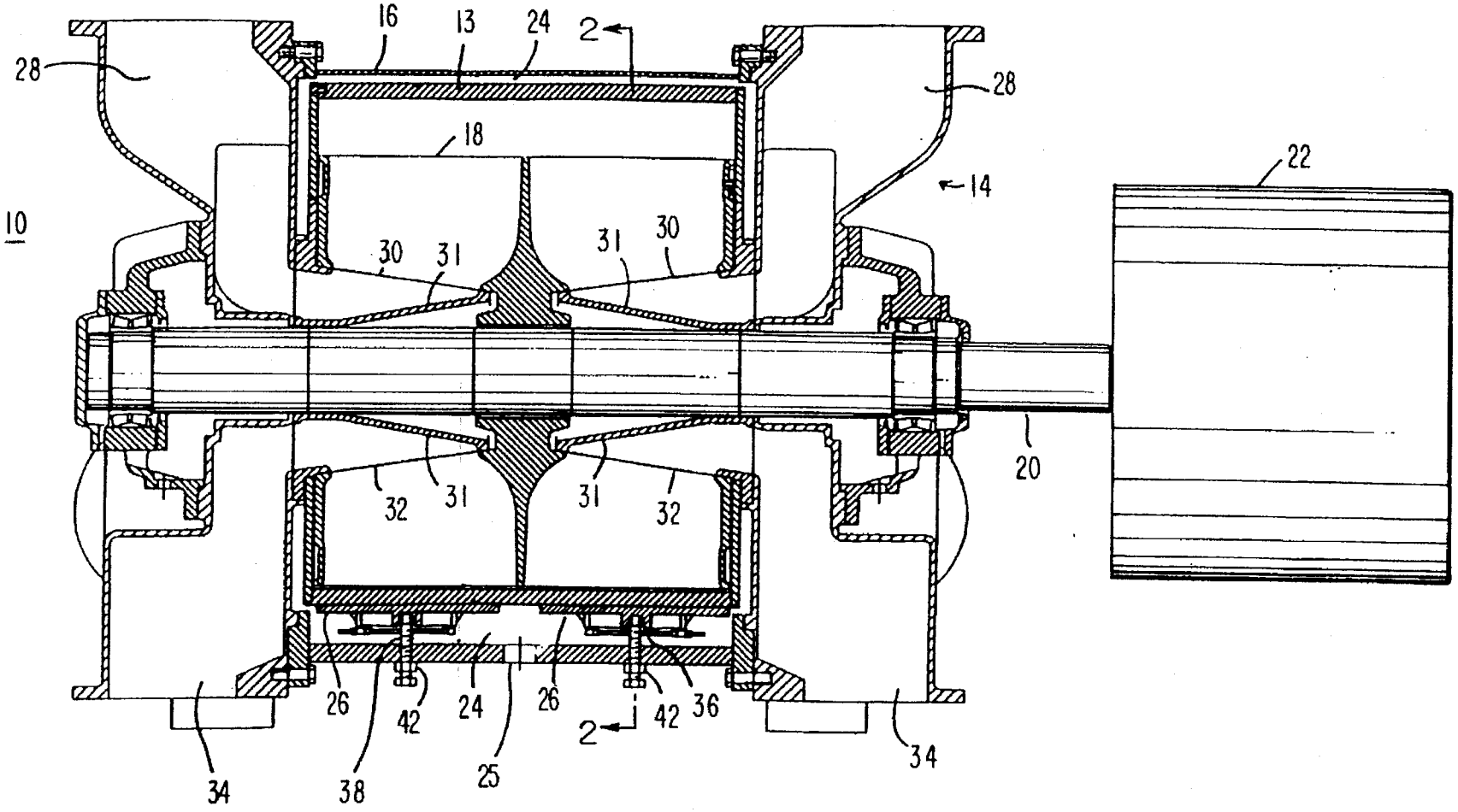
FIG. 1 is a simplified staggered sectional view of an illustrative liquid ring pump constructed in accordance with the principles of this invention.

A cross-sectional view of an illustrative liquid ring pump 10 having a rotating canister 13 is shown in FIG. 1. Pump 10 includes a stationary housing 14 having a hollow, substantially cylindrical housing member 16. Rotor 18 is mounted on shaft 20 for rotation with the shaft about a shaft axis which is laterally offset from the central longitudinal axis of housing member 16. The rotation of shaft 20 is powered by motor 22.

Canister 13, which is hollow and substantially cylindrical, is disposed substantially concentrically inside housing member 16. The outer cylindrical surface of canister 13 is radially spaced from the inner surface of housing member 16 by a clearance 24. A quantity of pumping liquid (e.g., water; not shown) is maintained in canister 13 so that when shaft 20 rotates rotor 18, the axially and radially extending blades of rotor 18 engage the pumping liquid and form it into a recirculating hollow ring inside canister 13. Because canister 13 is eccentric to rotor 18, this liquid ring is also eccentric to the rotor. The outer surface of the liquid ring engages the inner surface of canister 13 and causes canister 13 to rotate at a substantial fraction of the velocity of rotation of the liquid ring.

The rotation of canister 13 with the liquid ring reduces fluid friction losses in the pump by reducing the velocity difference between the liquid ring and canister 13. Reducing fluid friction losses increases the operating efficiency of the pump.

Gas to be pumped ("compressed") by the pump is supplied to the spaces ("chambers") between circumferentially adjacent rotor blades on one circumferential side of the pump via intake conduits 28 and inlet apertures 30, the latter being disposed in port members 31, which are part of the stationary structure of the pump. Inlet apertures 30 communicate with rotor chambers which are effectively increasing in size in the direction of rotor rotation because the inner surface of the liquid ring that forms one boundary of these chambers is receding from the shaft axis on this side of the pump due to the eccentricity of the liquid ring relative to the shaft axis. Accordingly, these chambers of increasing size pull in the gas to be pumped. After thus receiving gas to be pumped in the intake or suction zone of the pump, each rotor chamber moves around to the compression zone of the pump where the chamber decreases in size due to motion of the inner surface of the liquid ring toward the rotor axis. The gas in the chamber is thereby compressed. The compressed gas is discharged from the rotor via outlet apertures 32 and discharge conduits 34.

Figure 2:
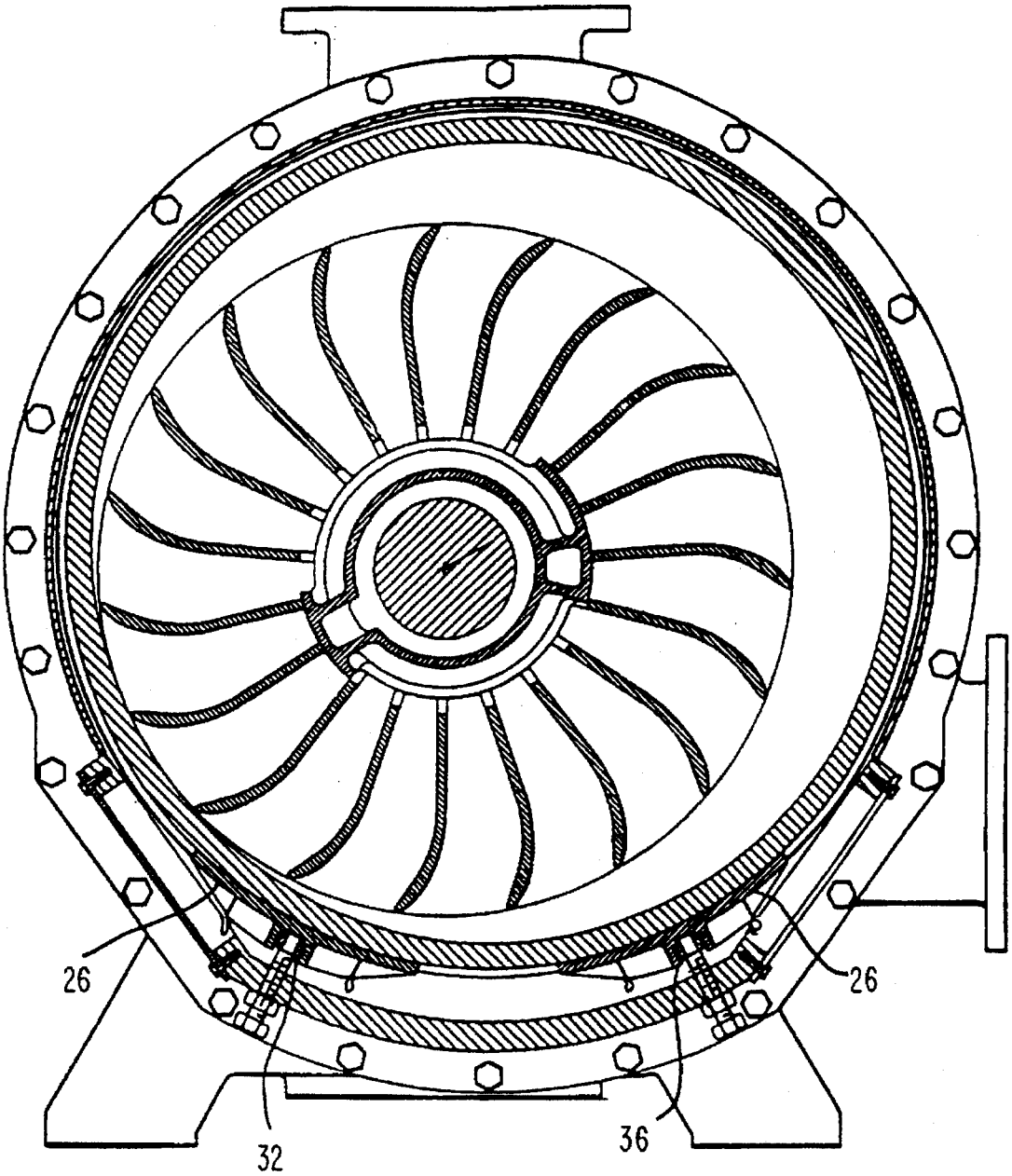
FIG. 2 is a simplified sectional view taken along the line 2—2 in FIG. 1.

Canister 13 is supported by radial fluid bearing pads 26, as shown in FIGS. 1 and 2. The bearing fluid used with bearing pads 26 is either a liquid (e.g., water) or a gas (e.g., air). An advantage of using localized pads 26 in place of an annular fluid bearing arrangement that completely surrounds the canister is that the inner surface of the housing member 16 can be manufactured with significantly lower tolerances than were previously possible. Instead of machining the entire inner surface of the housing member to match the shape of the canister, it is only necessary to machine the much smaller surface of bearing pads 26. Because, the clearance 24 between the outer surface of canister 13 and the inner surface of housing 16 can be larger and less rigidly controlled than when that entire clearance forms part of a fluid bearing for the canister, the construction of this portion of the pump is simplified. Preferably, clearance 24 is large enough to collect liquid that enters the clearance 24 during operation of the pump. Housing member 16 may be a substantially cylindrical member or any other configuration suitable for providing a rigid support to maintain alignment between the heads 14 and supporting bearing pads 26. The entire housing member 16 need not be rigid, so that, if desired, a flexible top cover plate could be used.

During operation, pumping liquid accumulates in clearance 24. Preferably, a drain aperture 25 is formed in the lower portion of housing member 16, so that the liquid may be drained from the clearance 24 via a suitable arrangement such as a pipe. Alternatively, liquid may be drained from the clearance 24 using internal passages formed within the housing 16.

Another advantage of using localized bearing pads such as pads 26 rather than the entire inner surface of housing member 16 as the fluid bearing for canister 13 is that bearing friction is reduced. The friction generated by a fluid bearing is proportional to the bearing surface area that is in contact with the moving part it supports. Because the surface area of bearing pads 26 is significantly less than the surface area of annular bearings that completely surround the canister, the friction produced by bearing pads 26 is much less than that of a bearing that surrounds the canister. For example, the area of bearing pads 26 may be only in the range from about 15% to about 35% of the cylindrical surface area of canister 13.

Radial bearing pads 26 may be of either the hydrodynamic or hydrostatic bearing type. As is well known, both bearing types are lubricated by a thin film of bearing fluid. For a hydrodynamic bearing, the operating pressure in the thin film is generated by the relative motion between the moving part (i.e., canister 13) and the bearing. With hydrostatic bearings, a pressurized bearing fluid supplied from an external source is provided between the bearing surface and the moving part.

When radial bearing pads of the hydrodynamic bearing type are used, the bearing fluid is preferably a liquid, such as water. As canister 13 rotates relative to bearing pads 26, a thin film of liquid is drawn between the canister 13 and the bearing pad 26 that allows canister 13 to rotate freely. The liquid bearing fluid can be introduced into the clearance between pad 26 and canister 13 using any suitable liquid supply arrangement. For example, tubes may be placed in the vicinity of pads 26 to wet the surface of canister 13 as it rotates. Pads 26 can also be provided with grooves or holes through which low pressure liquid can be supplied.

When bearing pads 26 are of the hydrostatic bearing type, either a liquid or a gas can be used as the bearing fluid. Liquid hydrostatic bearings can generally be manufactured with looser tolerances than gas hydrostatic bearings because the clearance between the moving part and the bearing surface is larger for liquid bearings than for gas bearings. However, gas bearings may be preferred when a supply of clean bearing liquid is not available.

Figure 3:
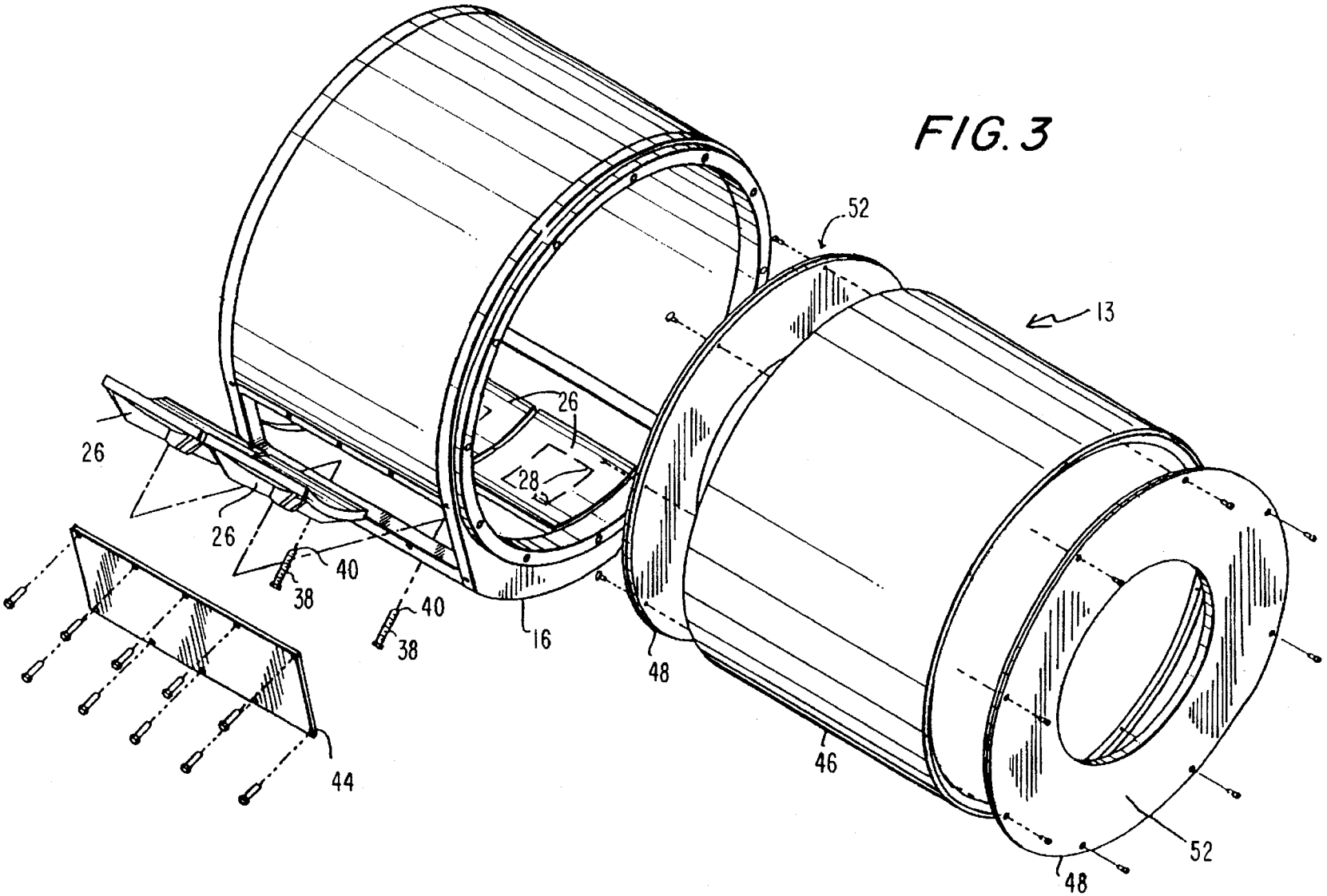
FIG. 3 is an exploded perspective view of a portion of the housing and a canister of an illustrative liquid ring pump constructed in accordance with the invention.
Figure 10:
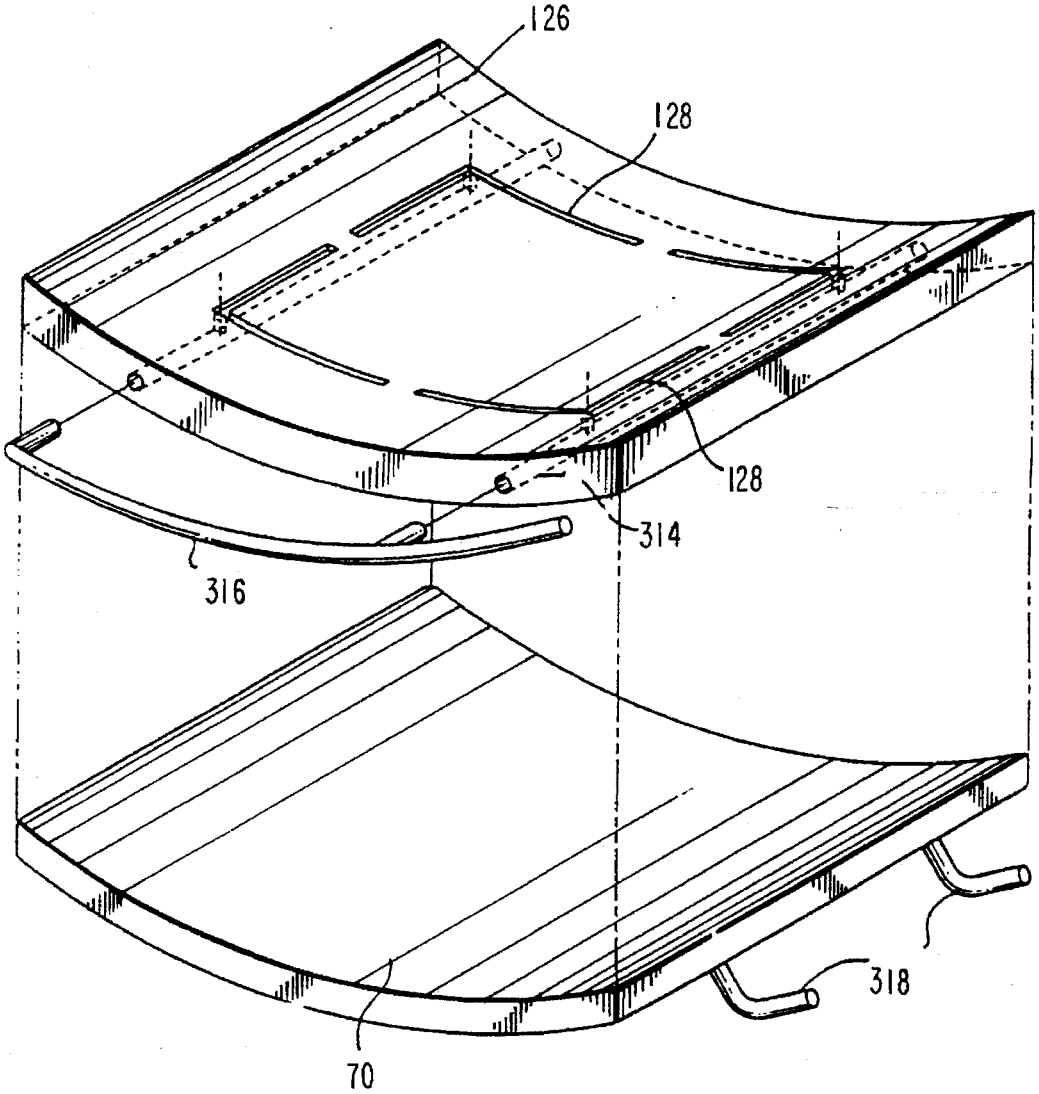
FIG. 10 is an exploded perspective view of an illustrative radial fluid bearing pad and a corresponding bladder constructed in accordance with the invention.

When bearing pads 26 are of the hydrostatic bearing type, the bearing fluid is preferably introduced into the clearance between bearing pads 26 and canister 13 via grooves 28, as shown in FIG. 3 (see also, grooves 128 in FIG. 10). The bearing fluid is preferably supplied to the grooves 28 and 128 by holes that are formed through pads 26 and 126, respectively. The holes are connected to a network of tubing (not shown) connected to the underside of pads 26. (See, e.g., tubing 316 connected to the underside of pads 126 in FIG. 10.) When gas (e.g., air) is used as the bearing fluid, gas can be supplied to grooves 28 at a pressure in the range of approximately 60 to 120 pounds per square inch. The grooves 28 may be "L" shaped slots arranged as shown in FIG. 3, so that there is a separate groove 28 in each quadrant of a pad 26. The grooves 28 may be approximately ⅛ inch wide by ⅛ in deep in size. The number of grooves 28 per pad 26, the size of the grooves 28, the layout of the grooves 28 on the pad 26, and the fluid pressure, or any combination of these, can be varied to increase or decrease the fluid flow rate, as desired. The fluid flow rate is preferably sufficient to support the load of canister 13, but is not so high as to be wasteful of the fluid.

As shown in FIGS. 1–3, pads 26 are preferably located directly underneath canister 13, so that pads 26 support canister 13 against the force of gravity. Another force encountered in operating liquid ring pumps with rotating canisters arises from the gas pressure differential from one circumferential side of the pump to the other, which tends to force the canister toward housing member 16 in a radial direction. The radial direction in which the canister is forced depends on pump speed and operating pressure. Pump 10 is preferably arranged so that the radial force due to this circumferential pressure differential is directed generally downward, parallel to the force of gravity. As shown in FIG. 2, with this arrangement two sets of bearing pads 26 can be placed symmetrically under the canister.

One suitable arrangement of bearing pads 26 is for one or more of the pads to be fixed to the housing during the assembly of the pump. Although the positions of the bearing pads 26 are not adjustable with this arrangement, with sufficiently accurate control of the manufacturing process, the pads can be positioned properly.

In accordance with one aspect of the present invention, the position of at least one of bearing pads 26 can be adjusted relative to the other parts of the pump (including other bearing pads 26), so that the pads 26 can be placed where desired to properly position the canister 13. In one embodiment, all of bearing pads 26 are individually adjustable. Any suitable arrangement for adjusting the position of pads 26 can be used. For example, a ball joint 36 can be provided at the center of the rear of each pad 26, as shown in FIGS. 1–3. If desired, each ball joint 36 can be formed from a bolt 38 having a rounded end portion 40 that engages a corresponding rounded indentation at the center of the rear of each pad 26 (see FIG. 3). A nut 42 is used to hold bolt 40 at the desired radial position, thereby providing the desired adjustability of the associated bearing pad 26.

In accordance with another aspect of the invention, at least one radial bearing pad 26 is mounted so that it can move to automatically comply with or complement the outer surface of rotating canister 13. In one embodiment, all of bearing pads 26 may be mounted in this way by means of ball joints 36. Thus pads 26 can pivot to accommodate slight manufacturing variations in the shape of canister 13. This allows canister 13 to be manufactured with less stringent tolerances than previously allowed. Further, during the operation of pump 10, canister 13 can deform due to the influence of the pumping load. Ball joints 36 also allow the pads to accommodate this type of variation in the shape of canister 13.

As shown in FIGS. 1–3, four pads 26 may be used to support the canister 13. If desired, a different number of pads can be used. For example, a single pad 26 can be used to support canister 13 or two or more pads 26 can be arranged in any suitable pattern to support canister 13. If more bearing pads 26 are used, the bearing pads 26 will more readily conform to variations in the shape of the canister 13. However, if the surface area of the bearing pads 26 is increased, friction due to the bearings will increase. The use of too many bearing pads 26 can also unnecessarily complicate the bearing structure.

Figure 4:
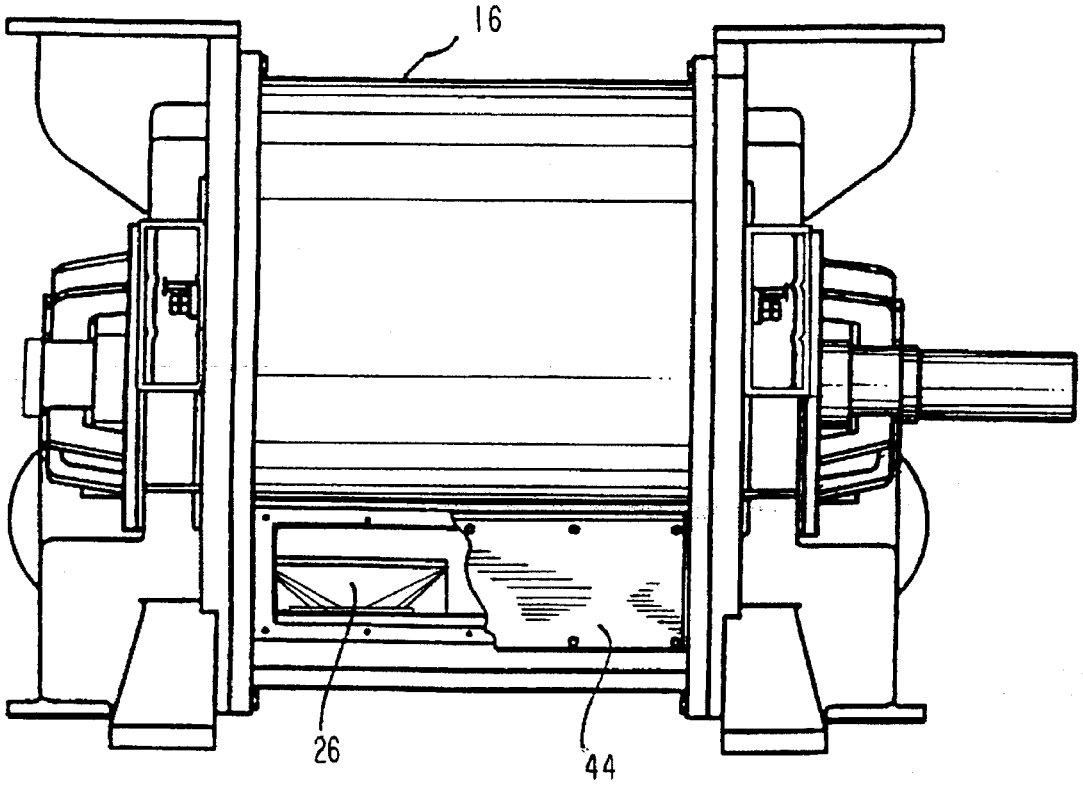
FIG. 4 is a simplified view, partly in section, of the liquid ring pump of FIG. 1.

As shown in FIGS. 3 and 4, the bearing pads 26 are preferably mounted in the housing member 16 behind access ports covered by a pair of access plates 44. One function of the access ports is to provide access to the bearing pads 26 during the process of manufacturing the pump, allowing the bearing pads 26 to be positioned properly. The access plates 44 can also be removed by service personnel in the field to make any necessary adjustments or repairs to the bearing pads 26 or any other part of the radial bearings. If necessary, the bearing pads 26 can be replaced.

Figure 5:
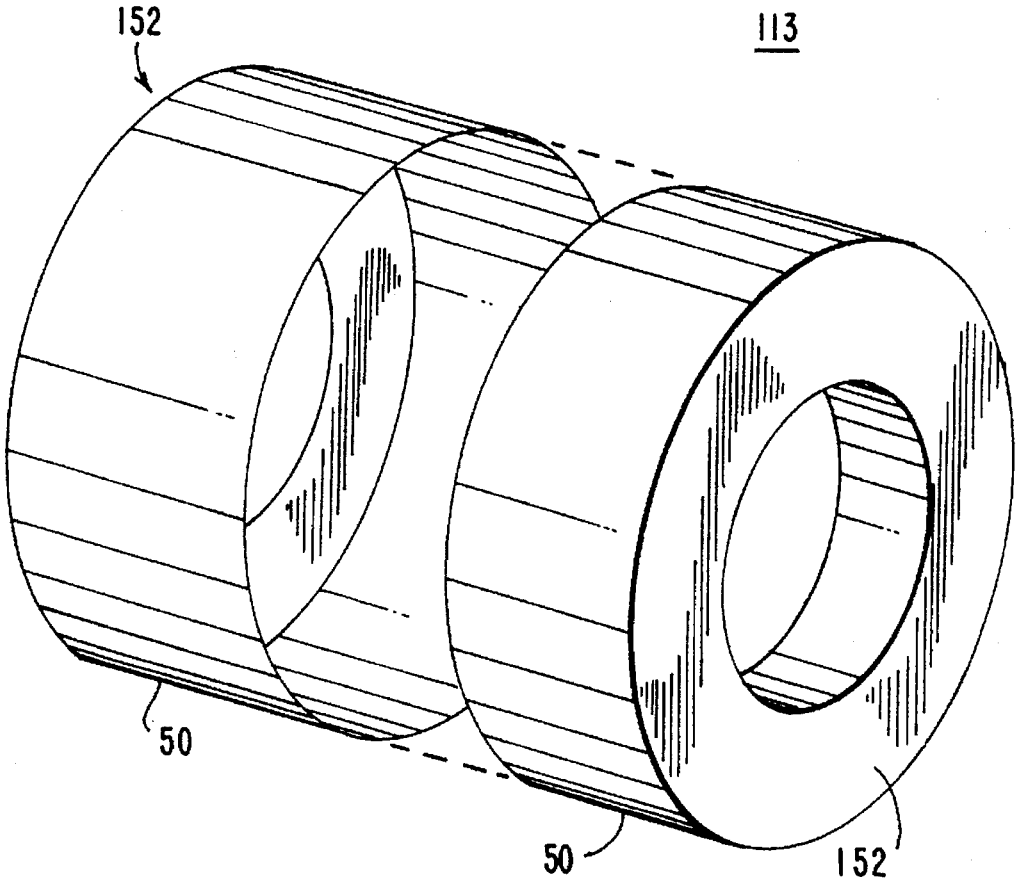
FIG. 5 is an exploded perspective view of an alternative embodiment of the illustrative canister of FIG. 3.

In the case in which the opposing axial ends of the pump are operated at different pressures, an internal axial pressure differential is generated that produces an axial thrust on the canister 13. Although the axial thrust may be slight, an axial fluid bearing 54 is preferably mounted on at least one axial end (more preferably at both axial ends) of housing member 16 (FIGS. 6 and 7) to confine the canister. Preferably one of these axial bearings is axially adjustable, and more preferably all of these axial bearing are axially adjustable. The axial bearings 54 can be used with any suitable rotating canister design. For example, as shown in FIG. 3, canister 13 can be formed from a cylindrical member 46 and two annular end plates 48. As shown in FIG. 5, a similar canister structure (canister 113) can be constructed from two mating canister halves 50.

The canisters 13 and 113 shown in FIGS. 3 and 5 preferably have axially opposing end faces 52 and 152. During operation, the canister is supported by the bearing pads 26, which must be machined fairly accurately to match the curvature of the canister. The inner surface of the housing member 16 is not machined, and, if desired, can be formed in any of a number of suitable shapes. For example, the housing may be substantially cylindrical or may have a rectangular axial cross-section. Although the inner surface of housing 16 is not machined, preferably the inner diameter of end faces 52 are machined so that there is a close running fit between the inner diameter of end faces 52 and the housing.

Figure 7:
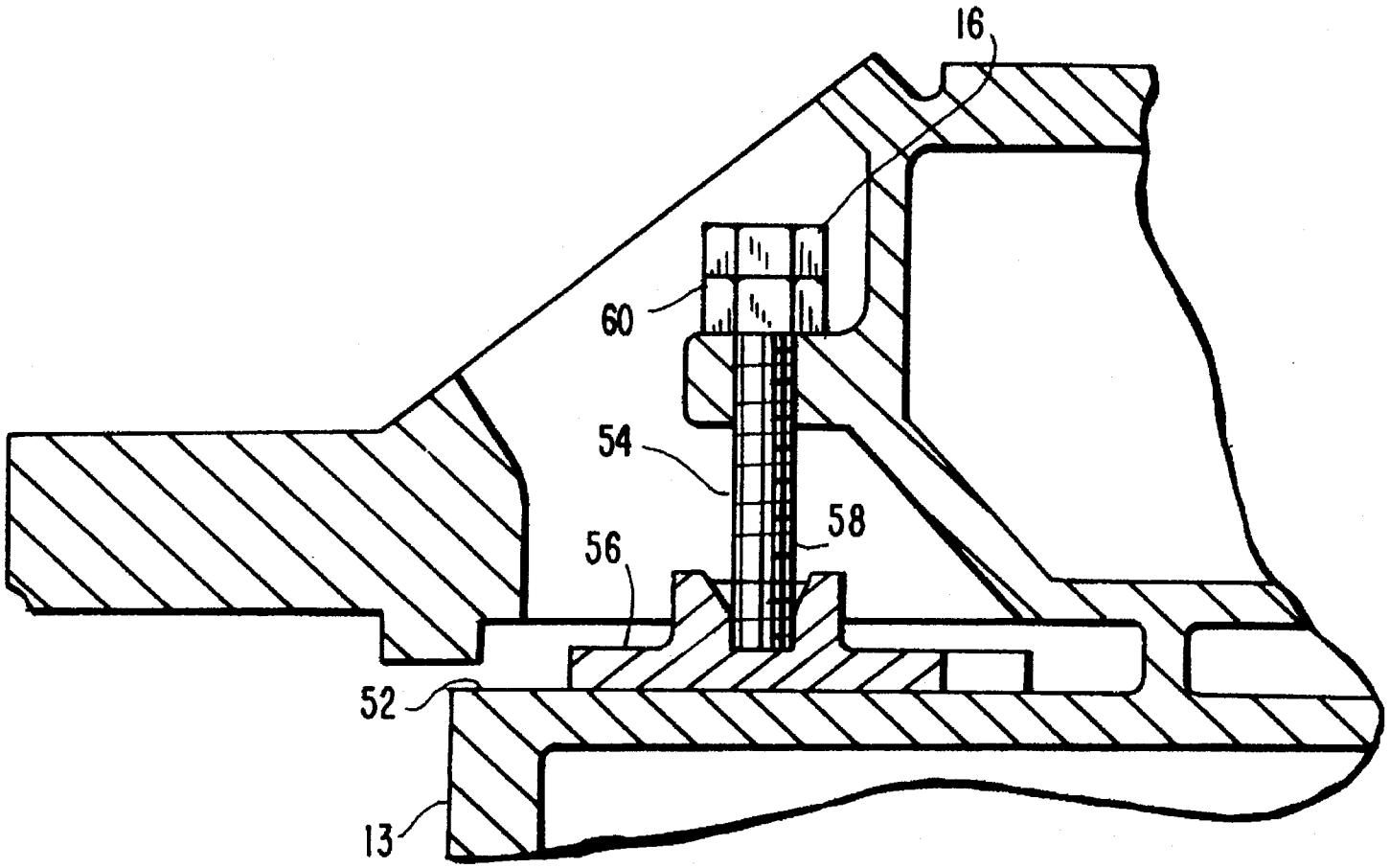
FIG. 7 is a simplified sectional view of an illustrative axial bearing taken along the line 7—7 in FIG. 6.

The axial bearings 54 axially confine the canister 13 (or canister 113) by acting on the end faces 52 (or end faces 152). An advantage of axially confining the canister is that wear between the canister and the portions of the pump that come into contact with the canister is reduced. An illustrative structure for an axial bearing 54 is shown in FIG. 7. Each such bearing preferably has an axially adjustable bearing pad 56, the axial position of which can be adjusted using bolt 58 and nut 60. A significant aspect of the design of axial bearings 54 is that the axial position of bearing pads 56 can be adjusted independently of the adjustment of the clearance between inlet apertures 30 and rotor 18, which is known as the "cone-rotor clearance" (see FIG. 3). The cone-rotor clearance is the primary mechanical adjustment to be made in the pump. Because the axial position of bearing pads 56 can be adjusted independently from the cone-rotor clearance, an undesirable interplay between these two adjustments is avoided.

As with radial bearing pads 26, axial bearing pads 56 can be of the hydrostatic fluid type, in which pressurized gas or liquid is supplied to the clearance between pads 56 and end faces 52 (or end faces 152). Alternatively, bearing pads 56 may be of the liquid hydrodynamic bearing type. Liquid hydrodynamic bearings do not require a pressurized external supply of fluid.

During operation of the pump 10, bearing pads 56 must be lubricated with a liquid such as water. If desired, the end faces 52 of the canister 13 (or end faces 152 of canister 113) can be lubricated with a low pressure supply of the liquid. The liquid is drawn into the clearance between the end faces 52 (end faces 152) and the bearing pads 56 by the rotation of the end faces past the bearing pads 56. The liquid can be supplied directly to the vicinity of the bearing pads 56 using any suitable arrangement such as tubing. The bearing pads 56 can also be lubricated by leakage of pumping liquid from the interior of the canister.

Figure 6:
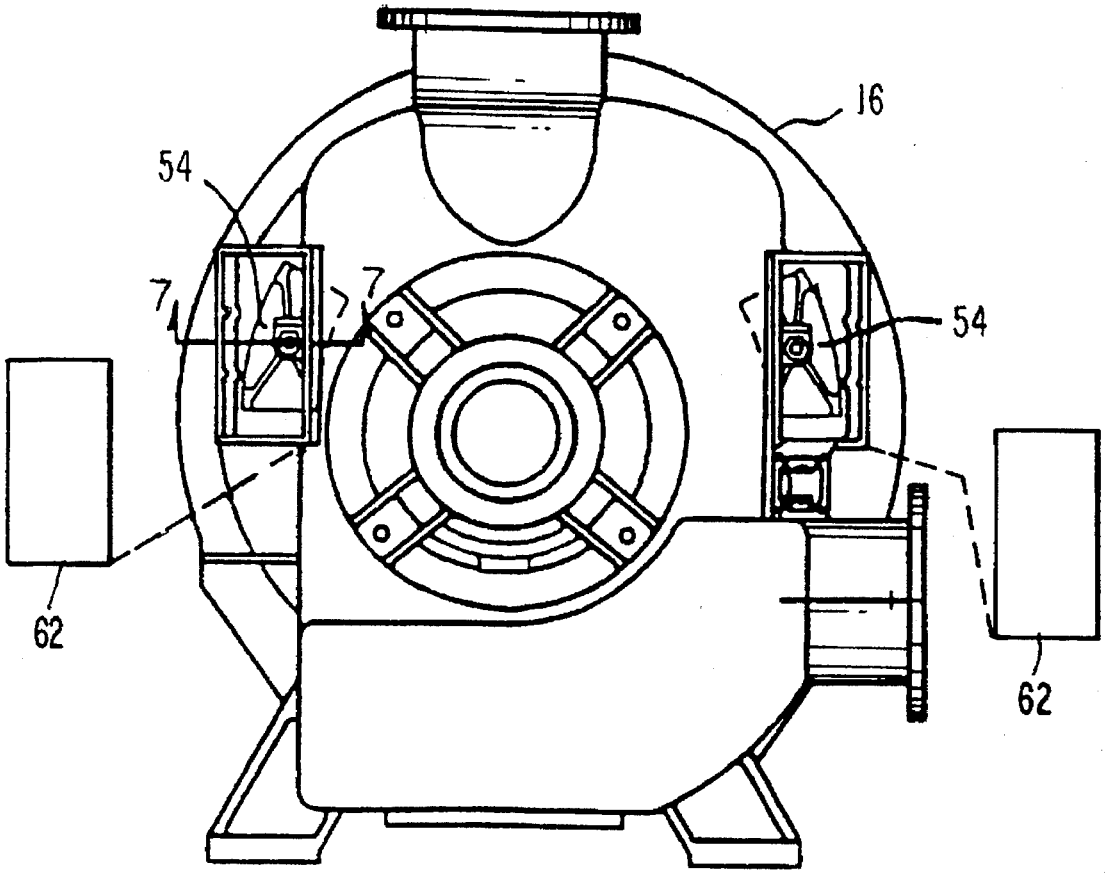
FIG. 6 is another simplified view of the liquid ring pump of FIG. 1.

The bearings 54 are preferably mounted behind access ports covered by removable access plates 62, shown removed in FIG. 6. As with the access plates 44 for bearing pads 26 (FIG. 3), one function of the access plates 62 is to provide access to the bearing pads 56 of bearings 54 during the assembly of the pump. The access plates 62 may also be removed by service personnel in the field to make any necessary adjustments or repairs to the bearing pads 56 or any other part of the axial bearings 54. If necessary, the bearing pads 56 can be replaced.

Figure 8:
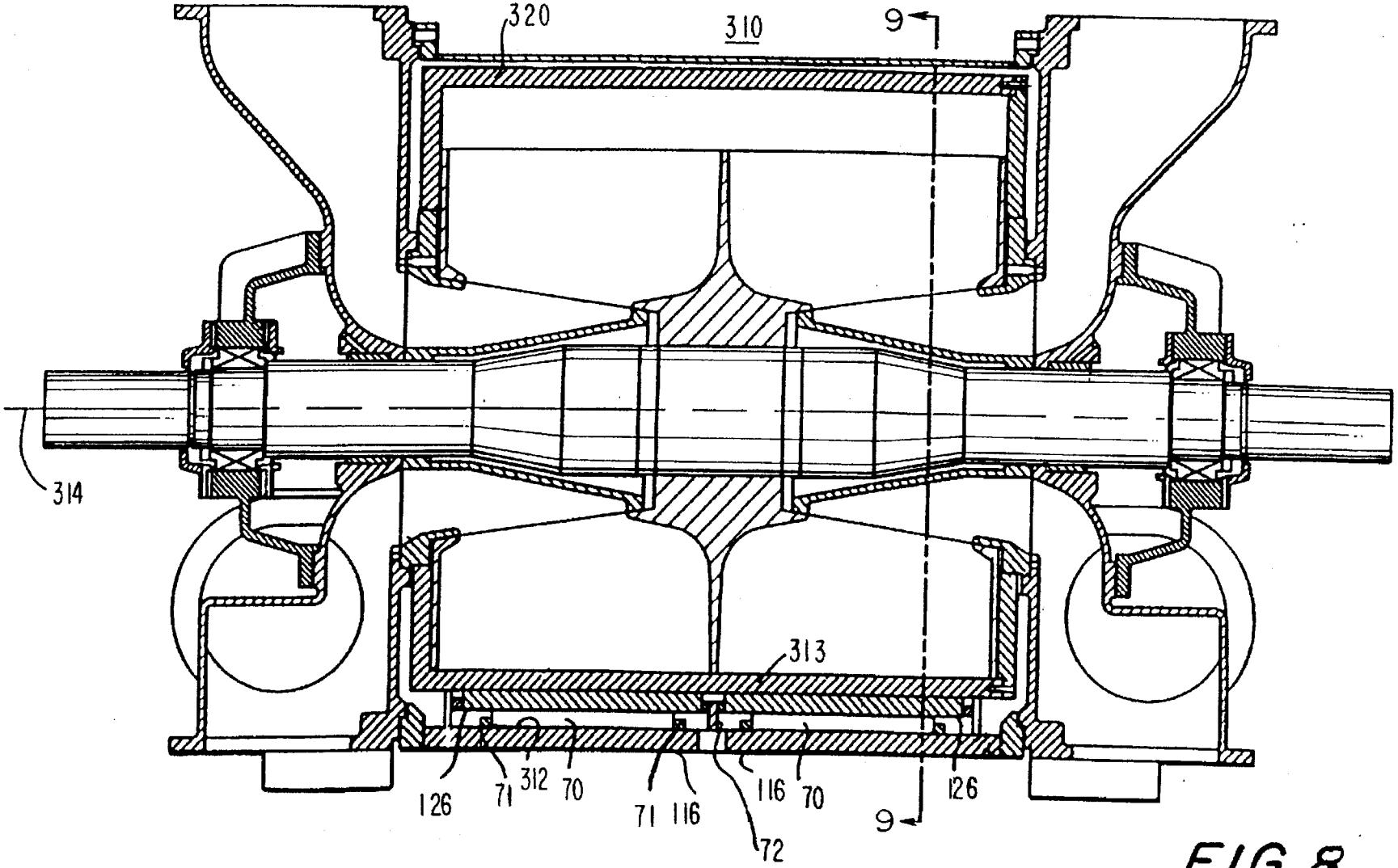
FIG. 8 is a simplified staggered sectional view of an illustrative liquid ring pump constructed in accordance with the principles of the invention.
Figure 9:
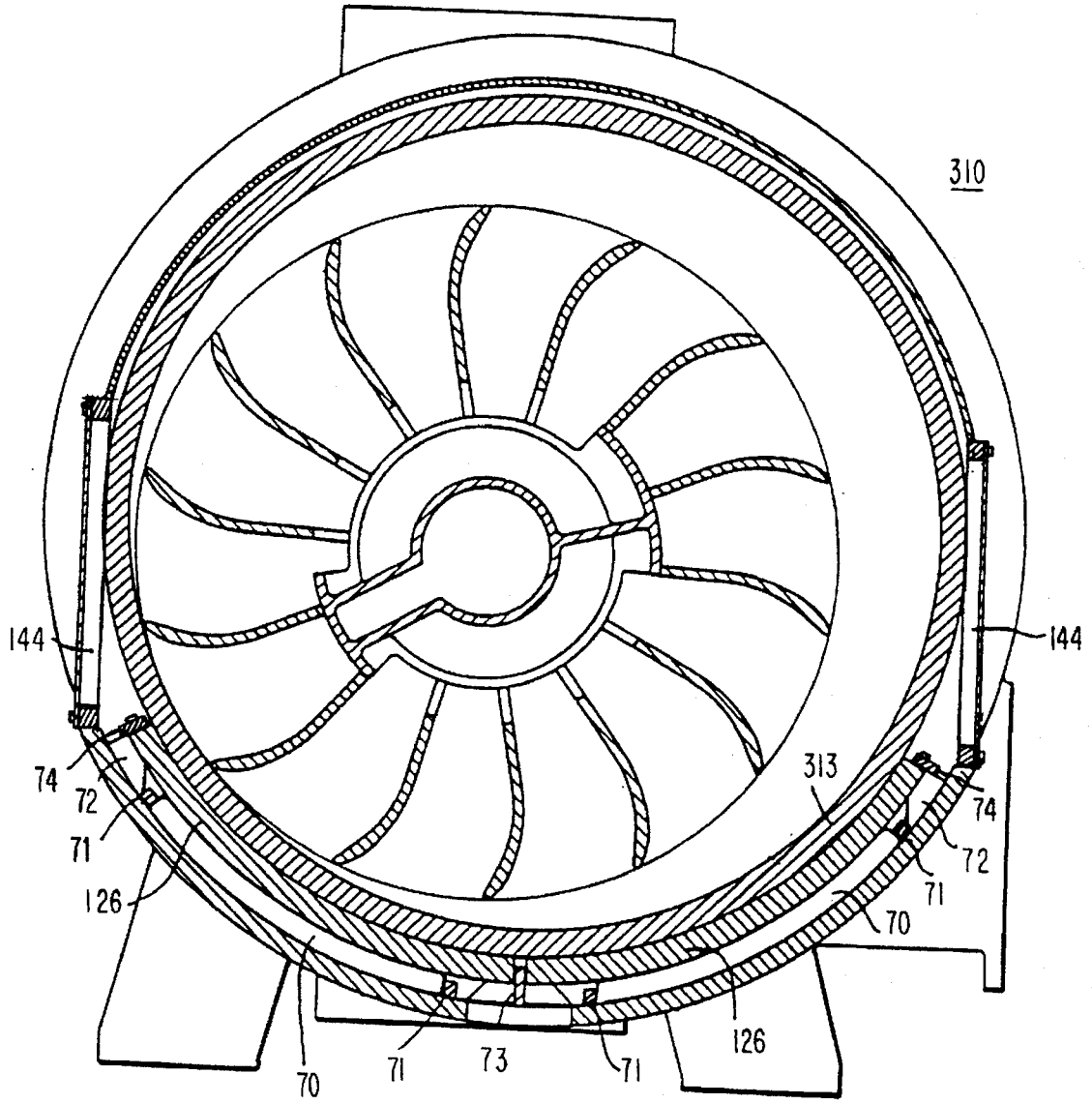
FIG. 9 is a simplified sectional view taken along the line 9—9 in FIG. 8.

Another aspect of the present invention relates to an alternative approach for mounting the bearing pads that support the canister of the pump. As shown in FIGS. 8–10, bearing pads 126 may be supported by fluid filled bladders 70. The fluid, preferably a liquid such as water, may be supplied to and drained from the bladders 70 using any suitable arrangement, such as a valve (not shown). The use of an incompressible fluid, e.g., liquid, is preferred whenever the radial position of the canister is important, which is usually the case. The desired radial position of the canister will be best maintained under varying load conditions when a liquid filled bladder is used. Ribs 71 affixed to housing member 116 of pump 310 maintain the position of the bladders 70 relative to the inner wall surface 312 of housing member 116. Ribs 71 form a raised rectangular boundary on the inner wall surface 312.

Ribs 72, which are also affixed to housing member 116, maintain the position of bearing pads 126 relative to axis 314 of pump 310. As shown in FIG. 9, the circumferential location of bearing pads 126 is established by rib 73, which is affixed to housing member 116, and removable bars 74. Removable bars 74 allow the bearing pads 126 to be easily installed (or removed) via the access opening formed when plates 144 are removed.

As shown in FIG. 10, one suitable arrangement for delivering bearing fluid to grooves 128 in bearing pads 126 is via integral passageways 314 formed in pads 126 in conjunction with external tubing 316. FIG. 10 also shows a suitable arrangement for filling and draining bladders 70 using tubing 318.

Bladders 70 may be constructed from any suitable flexible material capable of holding a fluid. For example, bladders 70 may be formed using a reinforced rubberized fabric. Suitable fabrics include nylon or the fabric sold under the trademark "Kevlar," both of which may be coated with polyurethane. Alternatively, polyester fabric bonded to rubber may be used. Typical operating pressures for bladders 70 are in the range of 15–50 pounds per square inch (psig).

Although a self-contained bladder 70 is illustrated, other arrangements can be used to support bearing pads 126. For example, a leak-tight flexible diaphragm fastened to either pad 126 or frame 116 with its closed volume filled with a fluid could be used to support bearing pads 126.

The radial position of bearing pads 126 may be adjusted by controlling the amount of liquid in bladders 70. Once the bladders 70 are adjusted and sealed, this position will be maintained under various loads and operating conditions.

Bladders 70 support the bearing pads 126 in such a way that the pads 126 are self adjusting. The bladders 70 allow the bearing pads 126 to move slightly to accommodate manufacturing variations in the shape of canister 313 (FIGS. 8 and 9) and variations that occur due to the influence of the pumping load during operation of pump 310. In this respect, bladders 70 operate similarly to the arrangement for supporting bearing pads 26 with ball joints 36 (FIGS. 1–4). An advantage of the bladder arrangement is that bearing pads 126 are supported over a relatively large portion of their surface area. As a result, the bearing pads 126 are well-supported under load. Supporting the bearing pads 126 with bladders 70 therefore makes it easier to position the bearing pads 126 and makes it less likely that the shape of the bearing pads 126 will become distorted during use.

Further, the more even distribution of the load that may be made using bladders 70 reduces distortions in the shape of housing member 116 under load, which generally allows housing member 116 to be thinner than housing member 16 (FIG. 3). In addition, bearing pads 126 can be formed from relatively featureless curved plates, rather than using a ribbed structure such as the one used for bearing pads 26 (FIG. 3). As described in connection with bearing pads 26 (FIG. 3), any suitable number of bearing pads 126 may be used to support the canister 313.

Figure 11:
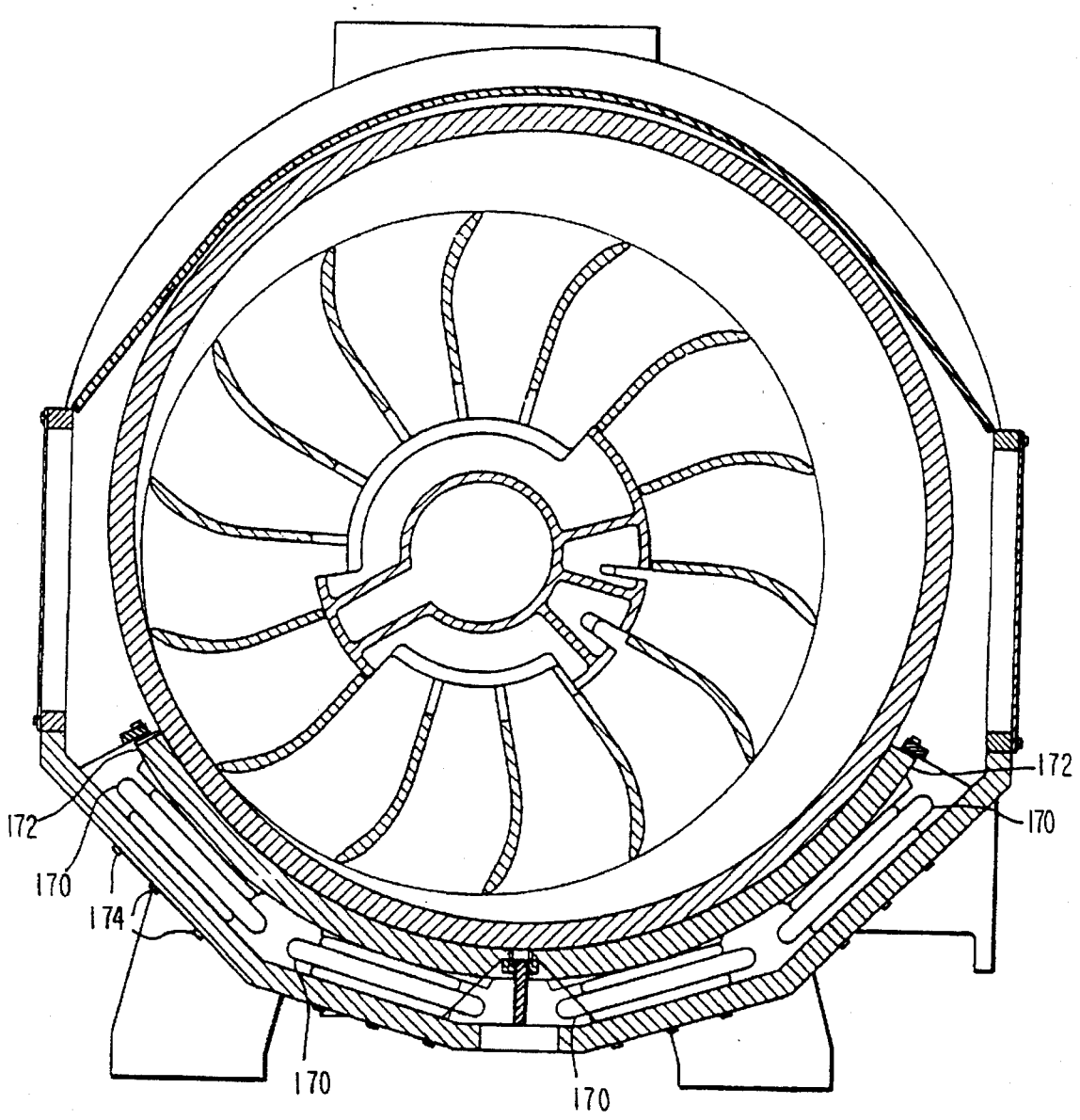
FIG. 11 is a sectional end view of an illustrative liquid ring pump constructed in accordance with the principles of the invention.

Another suitable arrangement for using bladders to support the bearing pads of the pump is shown in FIG. 11. Two bladders 170 support each bearing pad 172. The bladders 170 illustrated in FIG. 11 are commercially available pneumatic lift devices which are constructed from a rubberized fabric and have a circular cross section. A suitable commercially available bladder 170 is an actuator sold under the trademark "Airstroke" available from the Firestone Industrial Products Company of Carmel, Ind. Bladders 170 are attached to housing member 116 with screws 174.

Figure 12:
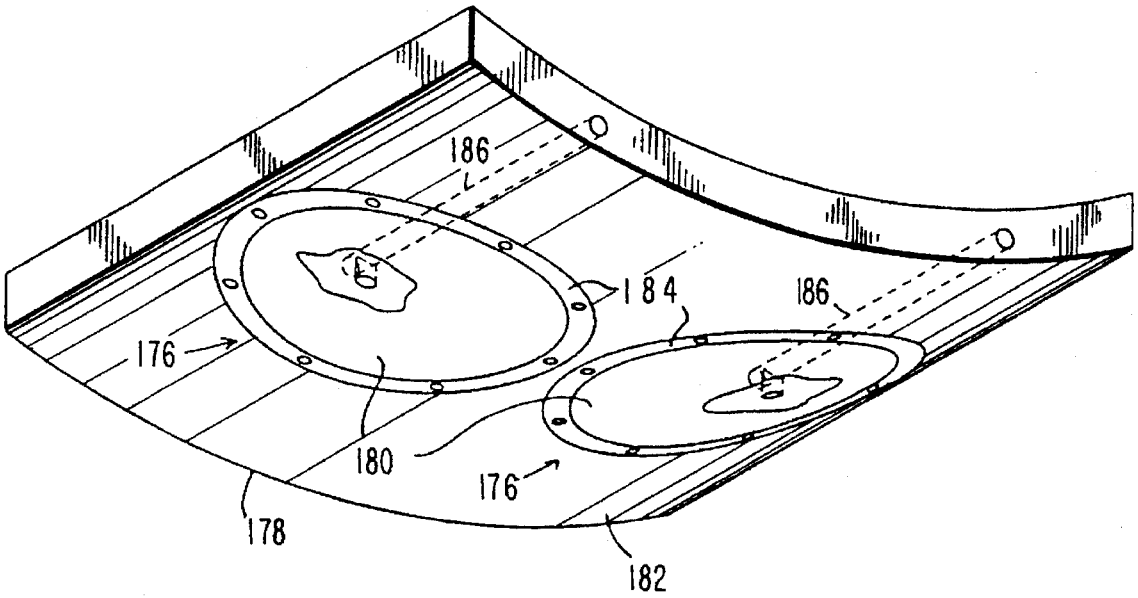
FIG. 12 is an exploded perspective view of an illustrative radial fluid bearing pad having two integral bladders.

The bladders used to support the bearing pads may also be formed as an integral part of the bearing pads, as shown in FIG. 12. Bladders 176 are formed by mounting flexible diaphragms 180 to the lower surface 182 of bearing pad 178 at flanges 184. Bladders 176 may be filled via cross-drilled holes 186. As with bladders 70 (FIGS. 8–10), bladders 170 (FIG. 11) and bladders 176 (FIG. 12) may be filled with any suitable fluid, preferably a liquid such as water. The number of bladders 170 (FIG. 11) or bladders 176 (FIG. 12) that are used per bearing pad will vary depending on the geometry of the pump and the anticipated load.

Figure 13:
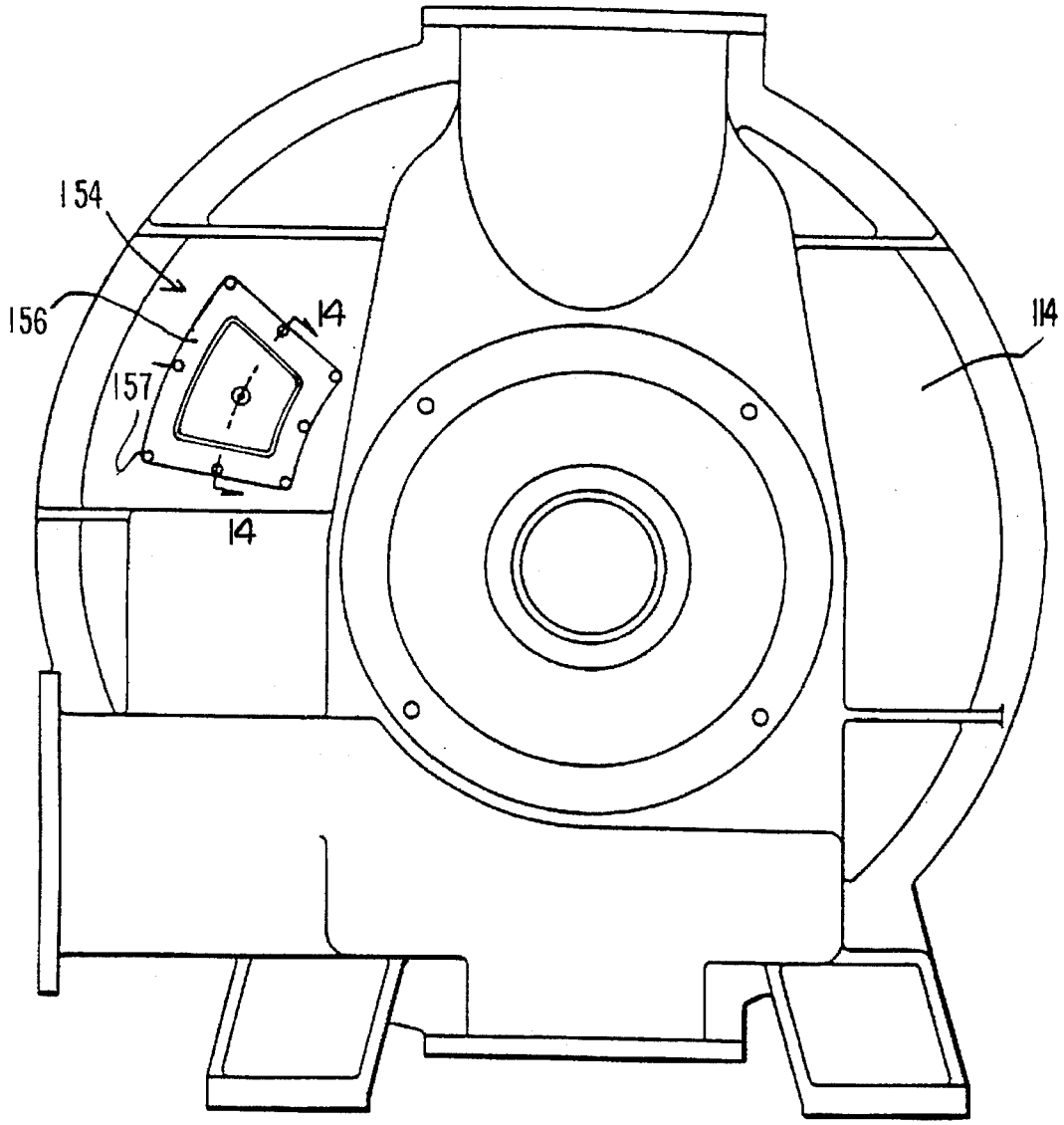
FIG. 13 is an end view of a liquid ring pump showing illustrative adjustable axial bearings.
Figure 14:
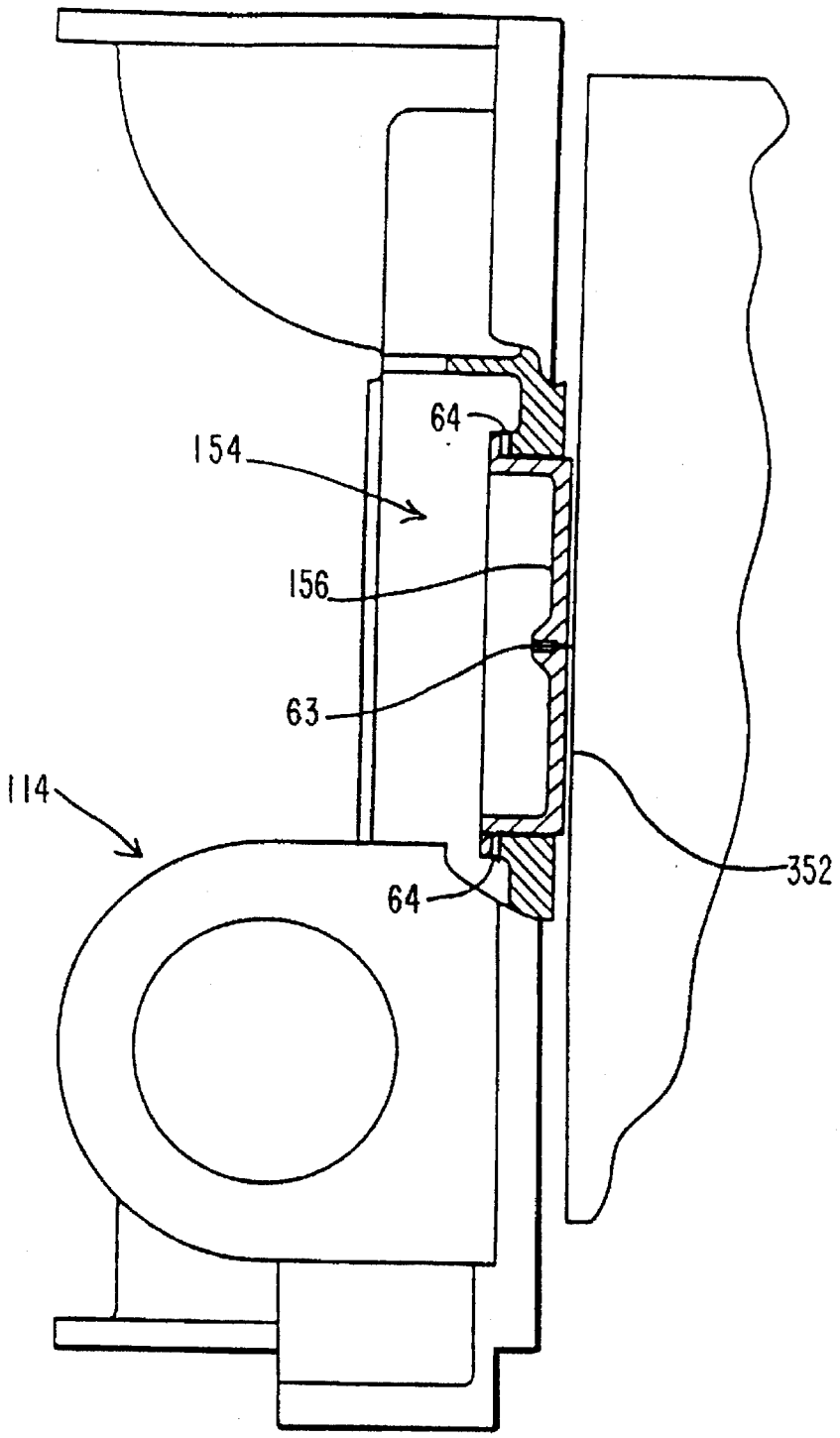
FIG. 14 is a simplified sectional view of an illustrative axial bearing taken along the line 14—14 of FIG. 13.

A further aspect of the present invention relates to an alternative construction for axial bearings 54 (FIGS. 6 and 7). As shown in FIG. 13, each axial bearing 154 has a bearing pad 156, which may be mounted to each head 114 with bolts 157. FIG. 14 is a cross-sectional view of axial bearing 154. The axial position of bearing pad 156 relative to head 114 is adjusted using shims 64 in the flange of bearing pad 156. A pressurized supply of bearing fluid is supplied via opening 63.

An arrangement such as that used for axial bearing 154 is generally less expensive to construct than the adjustable bearing pad arrangement shown in FIGS. 6 and 7.

Figure 15:
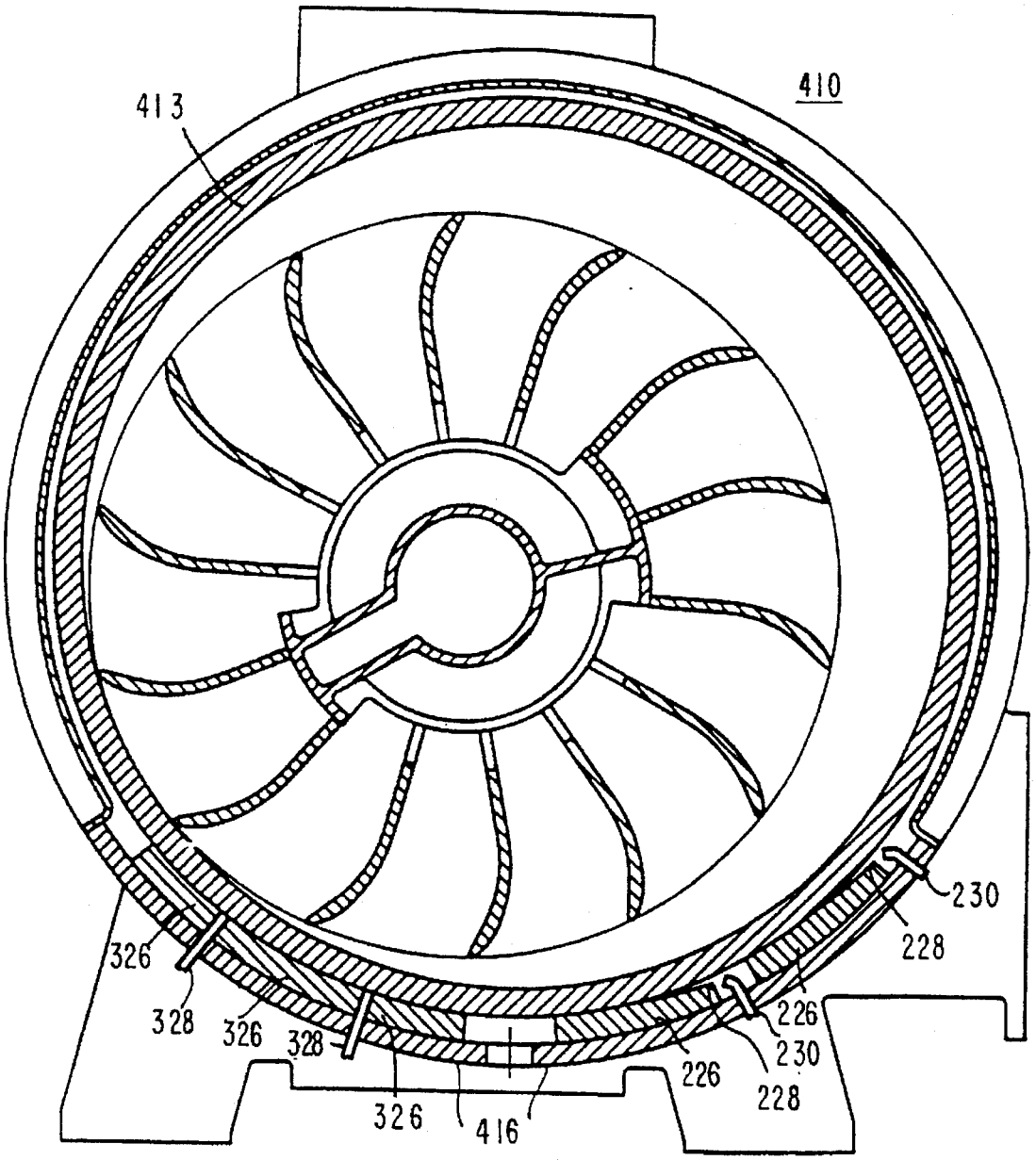
FIG. 15 is a simplified sectional end view of a liquid ring pump illustrating the use of hydrodynamic or hydrostatic non-adjustable radial fluid bearing pads.

Another aspect of the present invention is illustrated in FIG. 15, which is a cross-sectional view of a liquid ring pump design using non-adjustable bearing pads. For purposes of illustration only, the right side of pump 410 in FIG. 15 is shown using hydrodynamic pads 226. The left side of pump 410 in FIG. 15 is shown with a hydrostatic pad 326. Normally, only one configuration would be used in a single pump 410. The hydrodynamic bearing pads 226 typically have chamfers 228 on their leading edges to promote the flow of fluid into the clearance between the bearing pads 226 and canister 413. Bearing fluid is supplied to the leading edges of bearing pads 226 via tubes 230.

Hydrostatic pad 326 is supplied with bearing fluid using tubes or openings 328. The bearing fluid may be supplied directly to the clearance using grooves or slots or similarly shaped openings on the surface of bearing pad 326 as described, for example, in connection with grooves 28 of FIG. 3 or grooves 128 of FIG. 10.

Bearing pads 226 and 326 are fixed and therefore are not adjustable relative to housing member 416. However, pads 226 and 326 may be removable attachments to the housing member 416. If desired, the pads may be made up of two or more individual sections.

The bearing surfaces of pads 226 and 326 may be formed using any conventional high-performance surfacing material. For example, the surface of the hydrodynamic bearing pads 226 may be formed using an elastomeric material.

It will be understood that the foregoing is merely illustrative of the principles of the invention, and that various modifications can be made by those skilled in the art without departing from the scope and spirit of the invention. For example, the pumps shown in the accompanying drawings are double-ended pumps with "conical" (actually frustoconical) port members. However, the principles of the invention are equally applicable to liquid ring pumps having many other well-known configurations such as single-ended pumps, and pumps with flat or cylindrical port members.

The invention claimed is:

1. A liquid ring pump comprising;

a hollow housing member;

a hollow, substantially cylindrical canister for containing a quantity of pumping liquid, said canister being disposed in said housing member;

at least one radial fluid bearing pad disposed within said housing, said radial bearing pad having in arcuate surface for supporting said canister so that there is a clearance between said arcuate surface of said radial bearing pad and the outer surface of said canister, the area of said arcuate surface being substantially less than the area of the outer surface of said canister;

a rotor disposed in said canister for rotation about a rotor axis which is parallel to but laterally spaced from the central longitudinal axis of said canister, said rotor having a plurality of radially and axially extending blades spaced from one another about said rotor axis;

means for introducing bearing fluid into said clearance so that said bearing fluid substantially fills said clearance and supports said canister for rotation relative to said housing member about said central longitudinal axis;

means for rotating said rotor about said rotor axis so that said blades engage said pumping liquid and form it into a recirculating ring inside and substantially concentric with said canister, said ring cooperating with said rotor to provide chambers for pumping gas supplied to said pump for pumping, said canister being thus rotated by contact with said recirculating annular ring of pumping liquid; and first and second axially adjustable bearing pads separated from first and second end faces of said canister by respective clearances that receive bearing fluid, said first and second axially adjustable bearing pads axially confining said canister relative to said housing member as said canister rotates about said central longitudinal axis.

2. The liquid ring pump defined in claim 1 wherein said first and second axially adjustable bearing pads are mounted to said housing member by first and second bolts with respective first and second nuts, said first and second axially adjustable bearing pads having positions relative to said housing member that are adjustable by adjusting said bolts.

3. The liquid ring pump defined in claim 1 wherein said first and second axially adjustable bearing pads are mounted to said housing member using shims.

4. A liquid ring pump comprising;

a hollow housing member;

a hollow, substantially cylindrical canister for containing a quantity of pumping liquid, said canister being disposed in said housing member;

at least one radial fluid bearing pad disposed within said housing, said radial bearing pad having an arcuate surface for supporting said canister so that there is a clearance between said arcuate surface of said radial bearing pad and the outer surface of said canister, the area of said arcuate surface being substantially less than the area of the outer surface of said canister;

a rotor disposed in said canister for rotation about a rotor axis which is parallel to but laterally spaced from the central longitudinal axis of said canister, said rotor having a plurality of radially and axially extending blades spaced from one another about said rotor axis;

means for introducing bearing fluid into said clearance so that said bearing fluid substantially fills said clearance and supports said canister for rotation relative to said housing member about said central longitudinal axis;

means for rotating said rotor about said rotor axis so that said blades engage said pumping liquid and form it into a recirculating ring inside and substantially concentric with said canister, said ring cooperating with said rotor to provide chambers for pumping gas supplied to said pump for pumping, said canister being thus rotated by contact with said recirculating annular ring of pumping liquid; and at least one removable access plate connected to said housing member, wherein said housing member has portions defining at least one access port opening adjacent to said radial bearing pad and said access plate covers said access port opening.

5. A liquid ring pump comprising:

a hollow housing member;

a hollow, substantially cylindrical canister for containing a quantity of pumping liquid, said canister being disposed in said housing member, said canister having first and second end faces and a central longitudinal axis;

a rotor disposed in said canister for rotation about a rotor axis which is parallel to but laterally spaced from the central longitudinal axis of said canister, said rotor having a plurality of radially and axially extending blades spaced from one another about said rotor axis;

means for rotating said rotor about said rotor axis so that said blades engage said pumping liquid and form into a recirculating ring inside and substantially concentric with said canister, said ring cooperating with said rotor to provide chambers for pumping gas supplied to said pump for pumping;

means for supporting said canister for rotation relative to said housing member about said central longitudinal axis, said canister being thus rotated by contact with said recirculating annular ring of pumping liquid; and first and second axially adjustable bearing pads separated from said first and second end faces by respective clearances that receive bearing fluid, said first and second axially adjustable bearing pads axially confining said canister relative to said housing member as said canister rotates about said central longitudinal axis.

6. The liquid ring pump defined in claim 5 wherein said first and second axially adjustable bearing pads are of the hydrodynamic type and said bearing fluid is a liquid.

7. The liquid ring pump defined in claim 5 further comprising:

first and second threaded bolts for engaging said housing member and respectively positioning said first and second axially adjustable bearing pads relative to said housing member; and first and second nuts for respectively securing said first and second threaded bolts to said housing member so that the axial position to which said canister is confined is secured.

8. The liquid ring pump defined in claim 5 further comprising:

shims for axially separating said first and second axially adjustable bearing pads from said housing member; and means for securing said axially adjustable bearing pads to said housing member.

9. The liquid ring pump of claim 5 further comprising at least one removable access plate connected to said housing member, wherein said housing member has portions defining at least one access port opening adjacent to one of said first and second axially adjustable bearing pads and said access plate covers said access port opening.

10. A liquid ring pump comprising:

a hollow, substantially cylindrical canister containing a quantity of pumping liquid, said canister having a substantially cylindrical outer surface substantially concentric with a canister axis about which said canister is rotatable;

a fluid bearing pad structure for supporting said canister for rotation about said canister axis by means of a bearing fluid in a clearance between said bearing pad structure and a portion of the cylindrical surface of said canister, the area of said bearing pad structure opposite said cylindrical surface being substantially less than the area of said cylindrical surface, the part of said cylindrical surface which is not opposite said bearing pad structure at any instant of time being substantially unsupported by any fluid bearing;

a rotor disposed in said canister for rotation about a rotor axis which is substantially parallel to but laterally spaced from said canister axis, said rotor having a plurality of radially and axially extending blades spaced from one another about said rotor axis;

means for rotating said rotor about said rotor axis so that said blades engage said pumping liquid and form it into a recirculating ring inside and substantially concentric with said canister, said ring cooperating with said rotor to provide chambers for pumping gas supplied to said pump for pumping;

means for introducing bearing fluid into said clearance so that said bearing fluid substantially fills said clearance and supports said canister for rotation relative to said bearing pad structure about said canister axis; and a support structure for adjustably supporting at least a portion of said bearing pad structure relative to said rotor axis.

11. The apparatus defined in claim 10 further comprising:

a mounting structure for said fluid bearing pad structure for allowing said fluid bearing pad structure to move relative to said rotor axis during operation of said pump.

12. The apparatus defined in claim 10 wherein said canister is rotated about said canister axis by contact with said recirculating annular ring of pumping liquid.

13. The apparatus defined in claim 10 wherein said support structure allows the position of said portion of said bearing pad structure to be adjusted substantially radially to said rotor axis.

14. The apparatus defined in claim 10 wherein said bearing pad structure comprises:

a plurality of substantially separate fluid bearing pads.

15. The apparatus defined in claim 10 wherein said support structure comprises a bladder.

16. The liquid ring pump defined in claim 15 wherein said support structure comprises a diaphragm.

17. The apparatus defined in claim 15 wherein said bladder is constructed from a reinforced rubberized fabric.

18. The liquid ring pump defined in claim 15 wherein said bladder is filled with pressurized fluid.

19. A liquid ring pump comprising:

a hollow, substantially cylindrical canister for containing a quantity of pumping liquid, said canister having a substantially cylindrical outer surface substantially concentric with a canister axis about which said canister is rotatable;

a fluid bearing pad structure for supporting said canister for rotation about said canister axis by means of a bearing fluid in a clearance between said bearing pad structure and a portion of the cylindrical surface of said canister, the area of said bearing pad structure opposite said cylindrical surface being substantially less than the area of said cylindrical surface, the part of said cylindrical surface which is not opposite said bearing pad structure at any instant of time being substantially unsupported by any fluid bearing;

a rotor disposed in said canister for rotation about a rotor axis which is substantially parallel to but laterally spaced from said canister axis, said rotor having a plurality of radially and axially extending blades spaced from one another about said rotor axis;

means for rotating said rotor about said rotor axis so that said blades engage said pumping liquid and form it into a recirculating ring inside and substantially concentric with said canister, said ring cooperating with said rotor to provide chambers for pumping gas supplied to said pump for pumping; and means for introducing bearing fluid into said clearance so that said bearing fluid substantially fills said clearance and supports said canister for rotation relative to said bearing pad structure about said canister axis, wherein said canister has an end member for partly closing an axial end of said canister, and wherein said apparatus further comprises:

an axial fluid bearing for acting on said end member to help position said canister parallel to said rotor axis; and a holding structure for said axial fluid bearing for allowing the position of said axial fluid bearing to be adjusted substantially parallel to said rotor axis.

* * * * *